United States Patent [19]

Hentschel

[11] Patent Number: 4,627,765

[45] Date of Patent: Dec. 9, 1986

[54] TUNNELING MACHINE

[75] Inventor: Volker Hentschel, Dorsten, Fed. Rep. of Germany

[73] Assignee: Hochtief Aktiengesellschaft Vorm. Gebr. Helfmann, Essen, Fed. Rep. of Germany

[21] Appl. No.: 674,895

[22] Filed: Nov. 26, 1984

[30] Foreign Application Priority Data

Nov. 26, 1983 [DE] Fed. Rep. of Germany ..... 3342903

[51] Int. Cl.[4] ..... E21D 9/08

[52] U.S. Cl. ..... 405/146; 405/150; 405/141; 299/31; 299/33

[58] Field of Search ..... 299/31, 33, 55; 405/138, 141, 142, 143, 146

[56] References Cited

U.S. PATENT DOCUMENTS

| | | | |
|---|---|---|---|
| 3,967,463 | 7/1976 | Grandori | 299/33 X |
| 4,055,959 | 11/1977 | Fritz | 405/146 X |
| 4,140,345 | 2/1979 | Babendererde et al. | 405/142 X |
| 4,398,845 | 8/1983 | Stuckmann et al. | 405/138 X |
| 4,420,188 | 12/1983 | Robbins et al. | 299/33 X |
| 4,436,448 | 3/1984 | Magnus . | |
| 4,508,390 | 4/1985 | Bessac | 405/133 X |

FOREIGN PATENT DOCUMENTS

| | | | |
|---|---|---|---|
| 3015210 | 11/1981 | Fed. Rep. of Germany . | |
| 2952744 | 1/1985 | Fed. Rep. of Germany . | |
| 718513 | 10/1966 | Italy | 299/33 |

*Primary Examiner*—Stephen J. Novosad
*Assistant Examiner*—Michael A. Goodwin
*Attorney, Agent, or Firm*—Karl F. Ross; Herbert Dubno

[57] ABSTRACT

A tunneling machine of the type having a leading shield, a trailing shield, an annular form connected to the trailing shield by respective cylinder units for the emplacement of the concrete behind the machine and cylinder units for relatively advancing the leading and trailing shields, is also equipped with a telescoping shield assembly with its own set of cylinder units so that the concrete emplacement can be decoupled from the advance of the cutting head on the leading shield.

6 Claims, 6 Drawing Figures

TUNNELING MACHINE

FIELD OF THE INVENTION

My present invention relates to a tunneling machine and, more particularly, to a tunneling machine of the type which comprises a leading shield and a trailing shield adapted to temporarily line the excavated tunnel wall and advance with an excavating head which may be carried by the leading shield as the tunnel is advanced through a subterranean structure.

BACKGROUND OF THE INVENTION

It is known to provide tunneling machines in which an excavating head for removing the subterranean structures in advance of the tunneling machine are moved in a direction of tunnel cutting by hydraulic cylinder arrangements or the like. Behind the tunneling head, which is carried on a leading shield, a trailing shield may be provided to enclose the space within the tunnel by lining the tunnel wall temporarily.

These shields are moved as the machine excavates and progresses through the tunnel and the trailing shield may be provided with an apron or falsework (annular form) which can temporarily close an annular space formed between casing sections which are removably assembled in the tunnel and the wall so that concrete or some other hardenable composition can be continuously emplaced around these casing sections with the concrete front advancing as the falsework or form apron is progressively advanced together with the machine shields.

The piston-and-cylinder arrangements, hereinafter referred to as cylinder units, which connect the falsework apron or form to the shields, are generally angularly equispaced at the rear end of the trailing shield.

Along the periphery of the shields, moreover, a number of shield-advancing cylinder units can be provided, also in an angularly equispaced relationship. This allows, for example, upon extension of the latter cylinder units, the advance of the leading shield relative to the trailing shield and, upon contraction of the latter units, the drawing of the trailing shield toward the leading shield.

An excavating machine operating in accordance with these principles is described in German Patent Document No. 30 15 210. Reference may also be had to U.S. Pat. No. 4,436,448 (corresponding to German Patent Document 29 52 744).

In the prior art machine of the German Patent Document No. 30 15 210 the leading shield and the trailing shield are connected directly to one another and a decoupling device is provided to enable the movement of the leading shield to be temporarily decoupled from the movement of the trailing shield. In this system the decoupling device is disposed at the rear of the trailing shield and comprises a plurality of blades which are distributed over the periphery of the trailing shield. Each of these blades is provided with a blade actuating cylinder unit.

This arrangement has been found to be highly complex, difficult to operate and incapable of satisfactorily allowing the progress of concrete emplacement simultaneously with the excavating operation.

In other words, the concrete emplacement frequently required the shutting down of the tunnel excavation or could not keep up with tunnel excavation where variations in the tunneling rates were encountered and, conversely, where tunneling rates had to be reduced for some reason, continuous emplacement of the concrete had to be interrupted. In addition, the conventional decoupling system was found to be inordinately complex.

OBJECTS OF THE INVENTION

It is therefore the principal object of the present invention to provide an improved tunneling machine such that complex mechanisms rearwardly of the trailing shield are not required and nevertheless both excavating and concrete emplacement efficiencies are increased.

Another object of this invention is to provide an excavating machine having improved functional decoupling of the excavating process on the one hand and the concrete emplacement on the other.

It is also an object of this invention to provide an improved tunneling machine whereby the drawbacks of prior art systems are obviated.

SUMMARY OF THE INVENTION

These objects and others which will become apparent hereinafter are attained, in accordance with the invention, in an excavating machine provided with a leading shield (which can carry the excavating head), a trailing shield and a form shiftable relative to the shield by respective cylinder units connected therewith for defining the front for concrete emplacement and wherein the decoupling means is constituted by a telescoping shield which is connected on the one hand with the rear edge of the leading shield and on the other hand is associated with a portion of the trailing shield retracting in the tunnel advance direction, and two sections or portions of the telescoping shield assembly being bridged by a plurality of telescope cylinder units which are pivotally connected to each of the shield portions. The rearwardly extending portion of the trailing shield reaches over the aforementioned form to the region at which the front for the concrete emplacement is located.

The telescoping shield is movable by the cylinder units assigned thereto to provide the necessary degree of freedom for the decoupling of the excavator operation from the concrete emplacement operation.

Advantageously, a first set of cylinder units is pivotally connected between a ring carrying the cylinder units connected to the annular form and the leading shield and extends through clearances in the telescoping shield.

BRIEF DESCRIPTION OF THE DRAWING

The above and other objects, features and advantages of the present invention will become more readily apparent from the following description, reference being made to the accompanying diagrammatic drawing in which.

SPECIFIC DESCRIPTION

Figure 1:
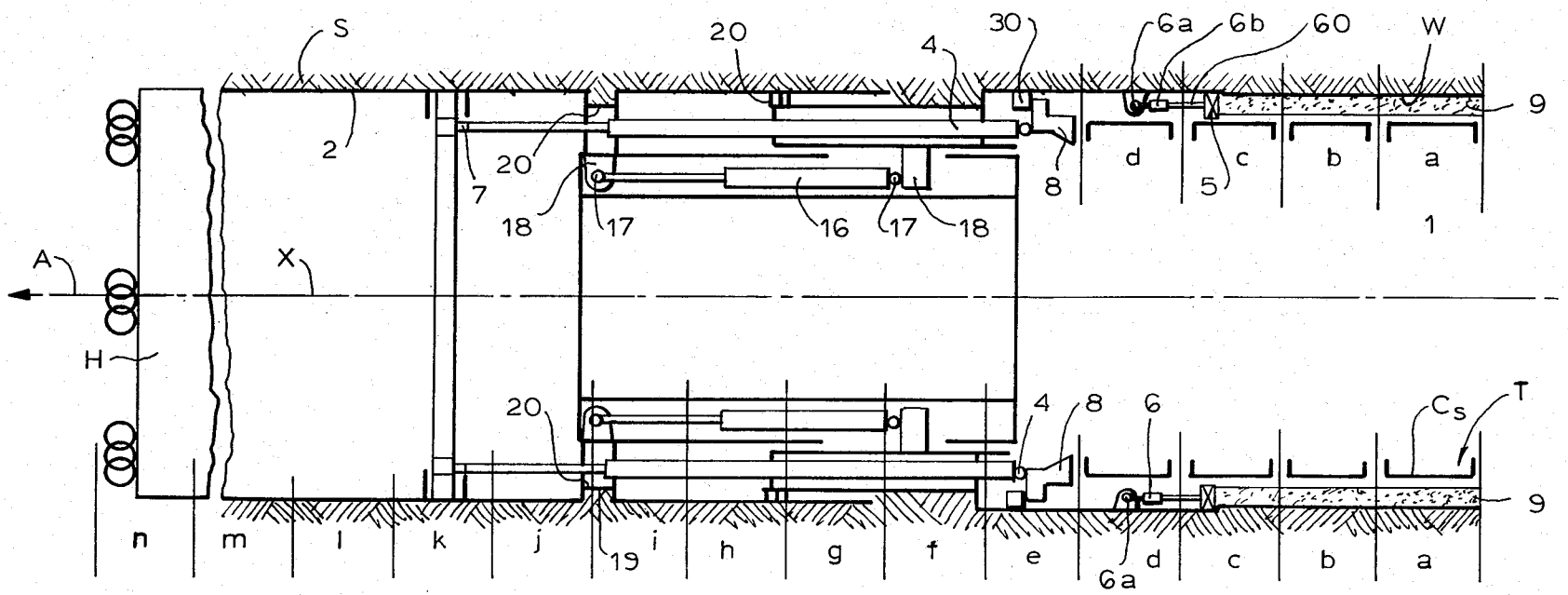
FIG. 1 is an axial section through the shield portion of an excavating machine according to the invention, the excavating head being represented only schematically.

From FIGS. 1 through 4, it can be seen that a tunnel 1 is advanced through a subterranean structure represented at S to form a gallery or the like by the movement of an excavating head H which has not been shown in detail because it is not per se significant to the invention. This head may include excavating bits with respective teeth and is generally provided with a conveyor for discharging detritus through the tunnel, a structure which also has not been illustrated so that the shields can be seen with greater clarity. The direction of tunnel advance is represented by the arrow A and the completed tunnel is shown at T. The tunnel has been provided with casings C which are connected together in a flange-to-flange relationship and which are themselves rings assembled from segments and having seals disposed between them. The tunnel casing principles are described in my commonly assigned copending application Ser. No. 673,775 filed Nov. 21, 1984 and commonly assigned with the present application. The space between the excavated tunnel wall W and the casings $C_s$ is filled with hardened concrete represented at 9 and referred to as placed or cast-in-place concrete.

The machine comprises, in addition to the head H, a shield assembly including a leading shield 2 in the form of a cylindrical shell which carries the head H by appropriate means not shown, a trailing shield 3 which runs to the front of the emplaced concrete and a multiplicity of cylinder units 4 for advancing the shield assembly and angularly equispaced around the axis X of the shields.

Figure 2:
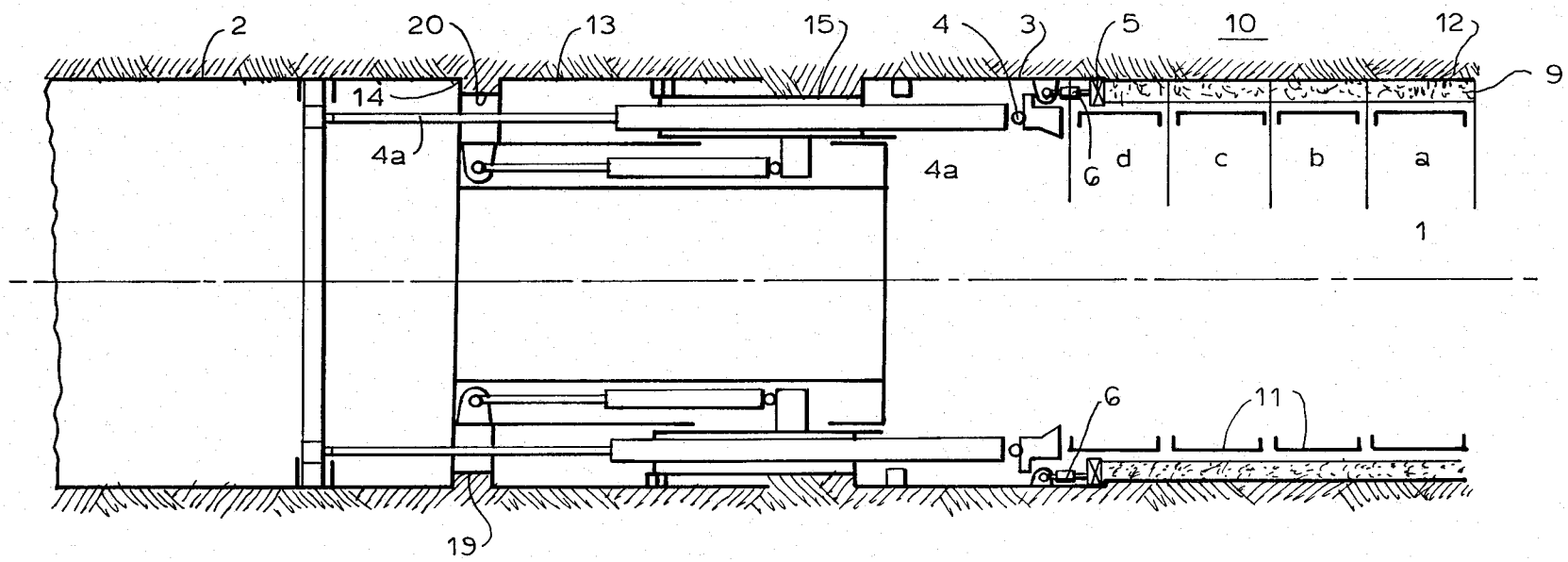
FIGS. 2 through 4 are sections similar to FIG. 1 showing the shields in other functional positions, representing conditions in which the decoupling effect comes into play.
Figure 3:
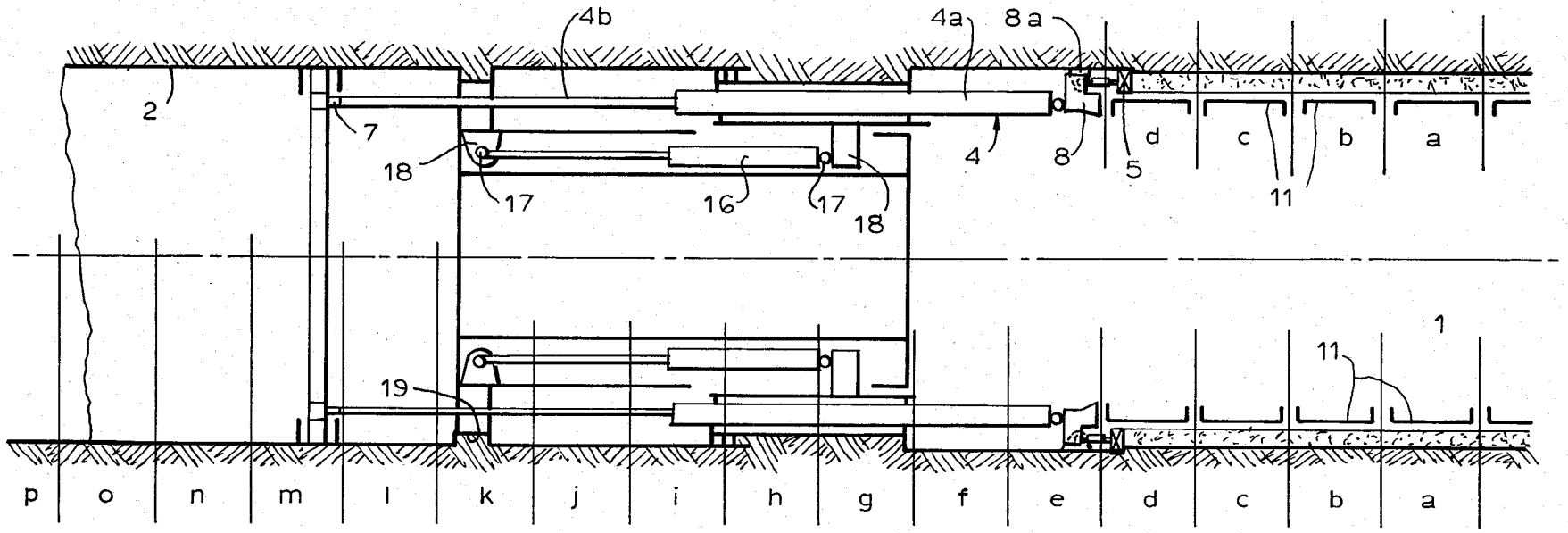
Figure 4:
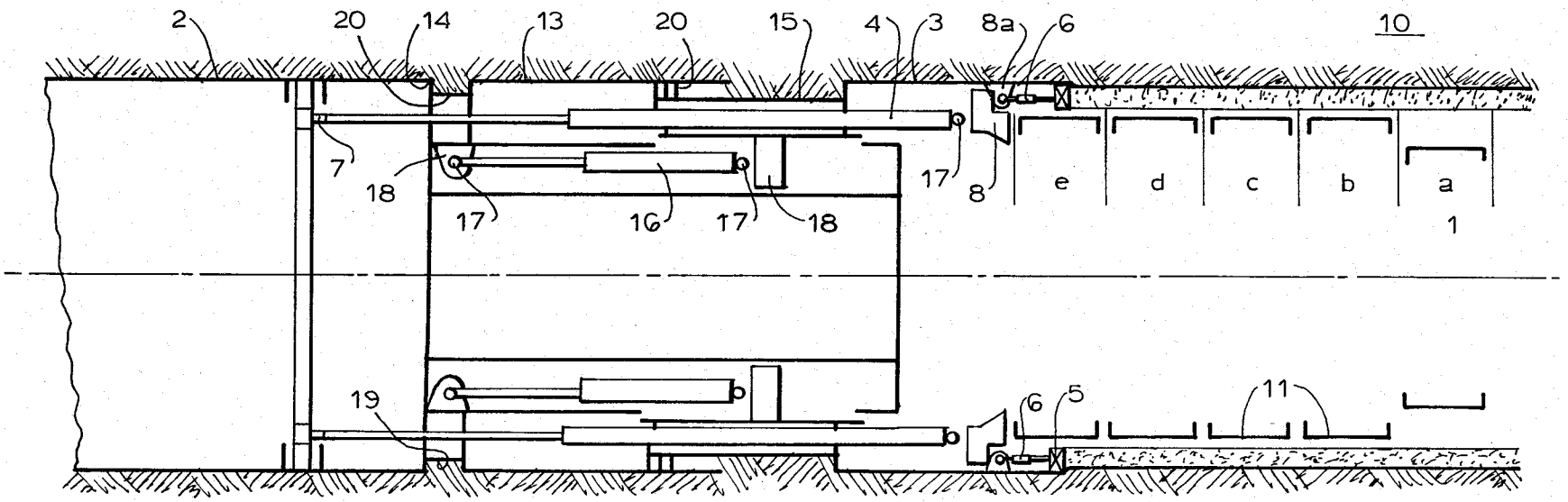

Each of the units 4 comprises a double acting hydraulic cylinder 4*a* and a piston which is not visible but is connected to a piston rod 4*b*. A relatively contracted condition of the cylinder units 4 is shown in FIG. 1 and a relatively extended condition is shown in FIGS. 2 through 4, for example.

The machine also comprises an end form 5, constituted as a ring and defining the falsework for concrete, the leading front of which is emplaced against this form 5. To allow the form 5 to advance at the rate of concrete emplacement, cylinder units 6 are operatively connected between this form 5 and the rear shield 3, e.g. by articulations 6*a* most clearly visible in FIG. 1.

Each of the cylinder units 6 also includes a double acting piston 6*b* having a piston rod 6*c*.

While the hydraulic actuation systems for the cylinder unit have not been illustrated, a conventional valve system for double-acting cylinder units, connected to a hydraulic pump and reservoir may be utilized.

The cylinder units 4 are pivotally connected at 7 with a leading shield. They are each also pivotally connected to a force or pressure distributing ring 8 which is adapted to be braced against the last casing section d forming the casing C. The casing sections can be removed once the concrete has hardened remote from the distribution ring 8 as is illustrated in FIG. 4.

The ring 8 can have a formation 8*a* which extends into line with the concrete 9 to provide additional support for the ring.

The reference numeral 12 designates the space between the casing C and the wall W into which the concrete 9 is pumped.

The tunneling machine is also provided with a decoupling assembly which allows decoupling of the movement of the leading shield 2 from the movement of the form 5. In the operation of such a tunneling machine, two basically different working conditions must be united. At the leading shield 2, excavation is carried out whereas at the trailing shield 3 the placement of concrete is effected. The shields 2 and 3 are, however, interconnected. Because of this interconnection, during machine operation without the decoupling, each disturbance of one of the two processes results in a slowing of the other process. This is the main cause of the poor efficiency of prior art continuous tunneling machines.

The decoupling device of the invention comprises a telescoping shield 13 which is connected to the rearward edge 14 of the leading shield 2. The outer member of the telescoping shield assembly 13 encloses a telescoping portion 15 of the trailing shield 3, this telescoping portion extending forwardly so tht the entire telescoping assembly 13, 14 is bridged by the cylinder units 4.

According to the invention, moreover, a number of telescope cylinder units 16 are angularly equispaced about the axis X and are articulated via pivots 17 and brackets 18 to the respective telescoping portions 13 and 15 to control the telescoping movement.

In the embodiment shown, the cylinder units 4 extend through clearances 13*a*, 15*a* in the telescoping portions. The cylinder units 4 are thereby encased by the telescoping assembly.

In the embodiment illustrated and in a best mode embodiment of the invention, a transition portion 19 at the leading end of the outer member 13 of the telescoping shield is of reduced diameter and is received in the leading shield 2. This has been illustrated in FIG. 5. This transition section generally will connect to the outer portion of the telescoping assembly which will have the diameter of the leading shield 2.

The other section 15 of the telescoping assembly has a reduced diameter by comparison to that of the trailing shield, the trailing shield 3 having again the diameter of the leading shield 2. Seals can be provided between the transition regions of the telescoping assembly and the respective shields where a sliding fit may be desired, e.g. as shown at 20.

FIGS. 1 through 4 show successive steps in the operation of the machine in the stepwise advance of a tunnel, the steps being represented in terms of increments of casing lengths a through p.

FIG. 1 shows the normal operation of the machine. With the ring 8 braced against the last casing ring 11 inserted and the cylinder units 4 retracted, the cylinder units 4 are extended to force the cutting head H in the direction of the arrow A thereby advancing the tunnel and moving the leading shield 2 in this direction. At the same time, concrete is being emplaced in the region around the last inserted casings as the trailing shield 3 is drawn in the direction of arrow A while the form 5 is shifted to the left with the trailing casing or relative to this trailing casing by the cylinder unit 6. During normal operation there is no decoupling, i.e. there is no telescoping movement of the two parts 13 and 15, both parts remaining in their mean positions. The process continues until the tunnel has advanced sufficiently to allow the insertion of another ring 11. In that case, the advance of the head H is halted and cylinder units 4 are contracted to draw the ring 8 to the left and allow insertion of a new casing section for the region 3 of the tunnel.

FIG. 2 shows the condition in which an interruption in the excavation has occurred. The shield 2 can no longer advance to the left or has been slowed in its advance to the left. Without actuation of the telescoping device, however, approximately a length of 600 mm of the cased portion of the tunnel can be supplied with concrete assembly by permitting the cylinder units 6 to contact and draw the form 5 to the left. When this is achieved, the machine would have to be brought to standstill if it were not for the telescoping units 13, 15. Should this condition be reached, the cylinder units 16 are hydraulically energized to draw the shield 3 to the left and permit the shield portions 13 and 15 to telescope the latter into the former and contract the cylinders 4. During this period, concrete can continue to be forced into the space between the moving form 5 and the previously emplaced concrete. Generally, this period suffices to allow the advance of head H again via the cylinder units 4.

It will be apparent that the telescoping cylinder units 16 can "float", i.e. need not be provided with hydraulic actuation through a valve or pump system when these units are drawn out or extended, the cylinder units 4 serving for this purpose.

A telescoping length of about 1250 mm or more is preferred and generally suffices to allow restoration of the operation of the head H.

FIG. 4 shows the situation which arises when there is an interruption in the concrete emplacement. Head H and the leading shield 2 continue to advance in the usual manner. The telescoping unit is permitted to extend so that any delay in concrete emplacement can be compensated by a lag of the rear shield.

When the concrete again becomes available for faster emplacement, the telescoping assembly 13, 15 can be contracted to its main position by the cylinder units 16. When, for example, the head advances 1.5 times more rapidly than the concrete emplacement, the telescoping unit draws the trailing shield along with half of the excavating head velocity. The extreme position of the telescoping unit has been shown in FIG. 3 and it is from this position that it returns to normal.

Figure 5:
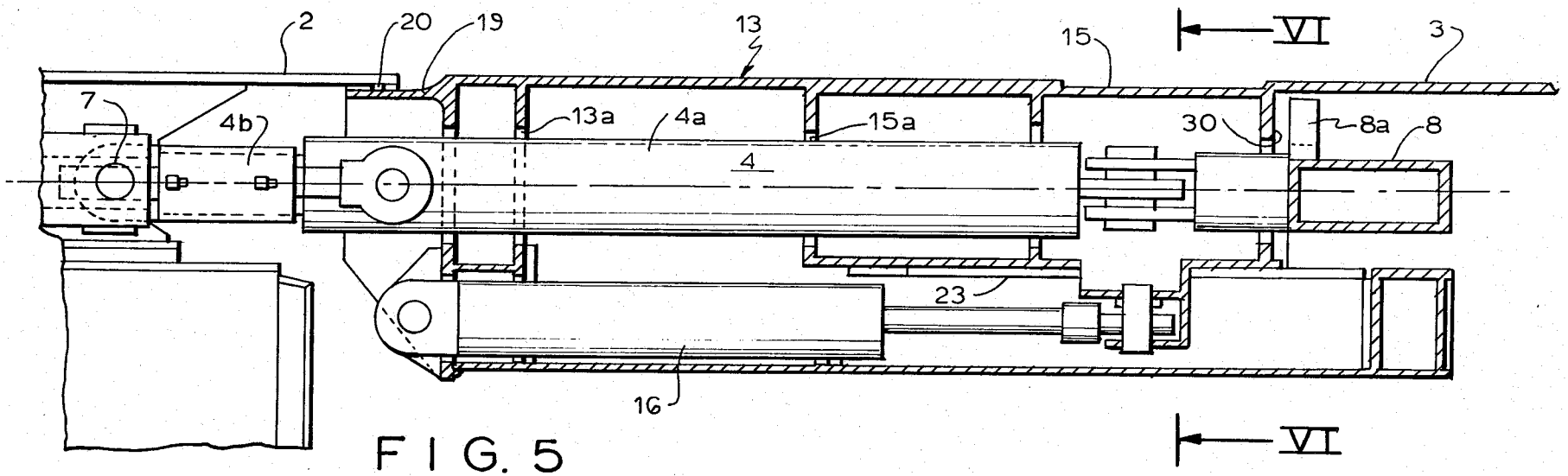
FIG. 5 is a less diagrammatic detail view illustrating the interfitting parts of a telescoping shield and drawn to a larger scale than FIGS. 1 through 4.
Figure 6:
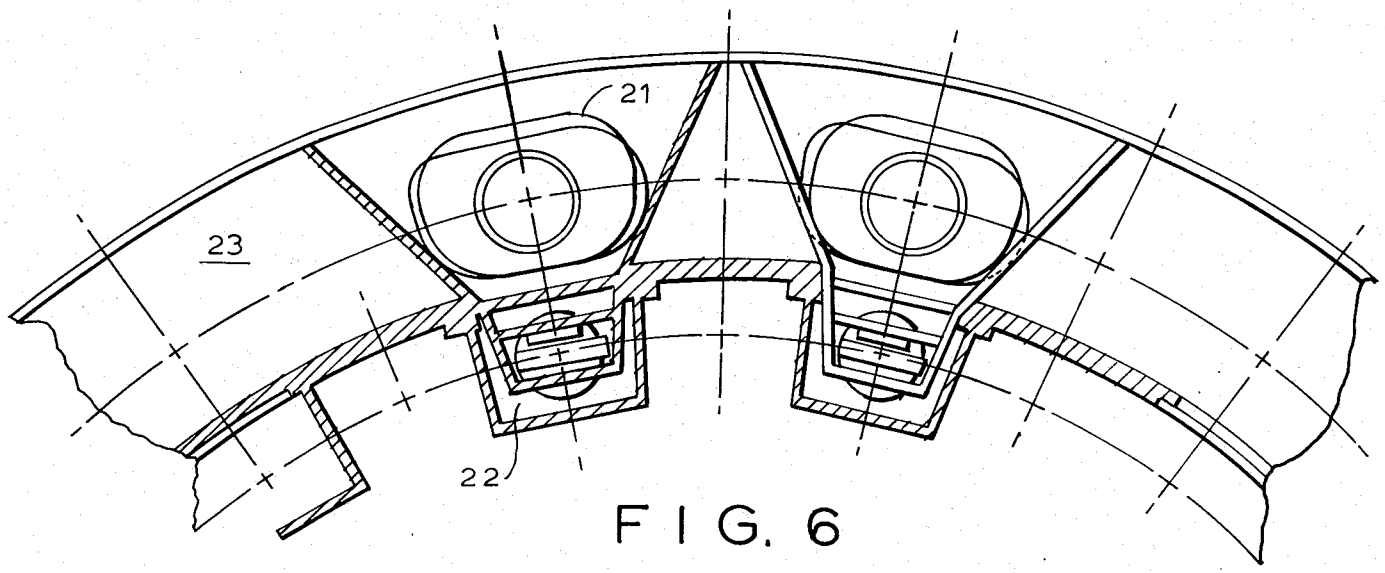
FIG. 6 is a section taken along the line VI–VI of FIG. 5.

FIGS. 5 and 6 show in greater detail the structures which may be used and which have been illustrated only diagrammatically in FIGS. 1 through 4. The cylinder units 4, 16 can be seen to extend through appropriate openings 21 and 22 in a guide ring 23, the mountings of the pivots 7, 17 being such that nonaxial movements are not applied to the cylinder unit.

An abutment as shown at 30 for engagement by the ring 8 enabling the latter to draw the trailing ring to the left in the manner previously described. This abutment is formed by a flange designated also as 30 in FIG. 5.

I claim:

1. A tunneling machine comprising:

a leading shield adapted to be advanced with an excavating head in a subterranean structure to form a tunnel having a tunnel wall along which said leading shield is advanced in a tunnel-advance direction;

a trailing shield disposed along said wall rearwardly of said leading shield with respect to said direction;

a telescoping shield assembly bridging said leading shield and said trailing shield and having an outer portion connected at a joint to a rear edge of said leading shield and receiving an inner portion connected to said trailing shield, said portions being telescopingly connected for contraction and extension of said shield assembly;

a plurality of angularly spaced first cylinder units pivotally connected to said leading shield and adapted to advance said leading shield relative to said trailing shield and along said tunnel, and to draw said trailing shield from said leading shield;

a plurality of second cylinder units interconnecting said portions of said assembly for contracting and extending said assembly independently of the advance of said leading shield; and a form connected to said trailing shield by a plurality of third cylinder units for defining a concrete emplacement front within said trailing shield.

2. A tunneling machine defined in claim 1 wherein said first cylinder units are operatively connected to a pressure distribution ring adapted to be braced against casing sections disposed in said tunnel.

3. A tunneling machine defined in claim 2 wherein said portion of said assembly connected to said leading shield is formed with a reduced diameter transition portion received in said leading shield.

4. A tunneling machine defined in claim 3, further comprising a seal disposed between said transition portion and said leading shield.

5. A tunneling machine defined in claim 3 wherein the inner portion of said assembly has a reduced diameter compared to that of said trailing shield and said trailing shield has substantially the same diameter as said leading shield.

6. A tunneling machine defined in claim 5, further comprising sealing means between said inner portion of said assembly and said trailing shield.

* * * * *